US009726079B2

(12) United States Patent
Wicks

(10) Patent No.: US 9,726,079 B2
(45) Date of Patent: Aug. 8, 2017

(54) SYSTEM AND METHOD FOR CLEANING AIR INDUCTION PATH OF INTERNAL COMBUSTION ENGINE

(71) Applicant: Ford Global Technologies, LLC, Dearborn, MI (US)

(72) Inventor: Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 202 days.

(21) Appl. No.: 14/330,428

(22) Filed: Jul. 14, 2014

(65) Prior Publication Data

US 2016/0010547 A1 Jan. 14, 2016

(51) Int. Cl.
*F02B 77/04* (2006.01)
*B08B 9/027* (2006.01)

(52) U.S. Cl.
CPC ..... *F02B 77/04* (2013.01); *B08B 9/027* (2013.01); *F02B 2077/045* (2013.01)

(58) Field of Classification Search
None
See application file for complete search history.

(56) References Cited

U.S. PATENT DOCUMENTS 4,989,561 A * 2/1991 Hein ..... F02B 77/04 123/198 A
5,133,322 A * 7/1992 McDougal ..... F02B 77/04 123/406.21
5,452,696 A * 9/1995 Flynn ..... F02M 65/007 123/198 A
5,816,272 A 10/1998 Leaphart
6,651,604 B2 * 11/2003 Ahmadi ..... C11D 1/72 123/184.21
6,830,630 B2 12/2004 Gatzke
2006/0287795 A1 * 12/2006 Samad ..... F02D 41/0215 701/54
2006/0289571 A1 * 12/2006 Saxman ..... F01P 11/06 222/630
2007/0012342 A1 * 1/2007 Stansilaw ..... B08B 9/0321 134/169 A
2008/0011327 A1 1/2008 Shriner et al.
2008/0283098 A1 * 11/2008 Ogasawara ..... F02M 25/00 134/22.1
2011/0088587 A1 * 4/2011 Willbrandt ..... B61C 5/04 105/62.1

* cited by examiner

*Primary Examiner* — Nicole Blan
*Assistant Examiner* — Pradhuman Parihar
(74) *Attorney, Agent, or Firm* — Brooks Kushman P.C.; Greg Brown

(57) ABSTRACT

A system and method for cleaning deposits, such as carbon build-up, from an air induction path of a motor vehicle engine. A reservoir mounted onboard the vehicle is in fluid communication with the induction path and contains a cleaning solution. A control module activates a valve to meters a flow of the solution into an air intake plenum in response to a signal indicating a parameter related to operation of the engine. The solvent may be delivered in a quantity calculated to collect at sump of the intake plenum and be drawn into the engine when intake air flow exceeds a threshold rate. The engine-related parameter may be distance travelled by the vehicle.

12 Claims, 3 Drawing Sheets

SYSTEM AND METHOD FOR CLEANING AIR INDUCTION PATH OF INTERNAL COMBUSTION ENGINE

TECHNICAL FIELD

The present invention relates to internal combustion engines, and specifically to a method and system for cleaning and/or maintaining a clean air induction path of such an engine.

BACKGROUND

Internal combustion engines (and particularly boosted or turbo charged engines) have a tendency to collect unwanted carbon deposits on the back side or fillet region of the intake valve as well as the choke area within the cylinder head immediately surrounding the intake valve. Such carbon deposits, commonly referred to as soot, result from the normal combustion process and can become attached to the metal surfaces of the valve and cylinder head by heat and pressure. As additional layers of soot begin to build up on top of one another, they may cause a restriction in the air intake path and therefore reduce the mass airflow to the cylinders. This may result in a decrease in overall efficiency of the engine. Even a single layer of soot may cause the surface texture of the collection area to be somewhat rough which may tend to increase the rate or likelihood of soot particle adhesion.

Cam phasing (late closing intake valve) may tend to exacerbate buildup of soot deposits immediately upstream from the intake valve because hot combustion gases are pushed back upstream from the combustion chamber into the air intake path, thereby heating that area. In addition to carbon from the combustion gasses, any engine crank case oil or other contaminants hanging in suspension or entrained in the inlet air charge collecting in this area will be turned to soot by the heat from the combustion gasses.

Possible sources of crank case oil present within the engine air path may be the positive crank case ventilation (PCV) system, exhaust gas recirculation (EGR) system, oil separation system, and/or leakage from turbo charger/super charger seals.

Internal combustion engines that use port fuel injection (PFI) technology have the fuel injectors located so as to inject fuel into the intake air before it passes through the intake valves into the cylinders. This allows the injector cone angle to be targeted so as to spray fuel at the back of the intake valve when in the open position, thereby delivering fuel directly onto the area where soot/carbon collection is known to be the most likely. The fuel spray has a cooling effect and, if a solvent or cleaning solution is included in the fuel formulation, may also have a self-cleaning effect.

In engines that utilize direct injection (DI) technology, however, the fuel is injected directly into the cylinder. Thus the fuel does not contact the back sides of the intake valves, so the cleaning/cooling effect present in the PFI system is not available.

It is known to clean undesirable deposits within a motor vehicle engine when the vehicle is in a maintenance garage, repair shop, or otherwise out of service. In general, this is performed by connecting a delivery tube to the air induction system of the engine while the vehicle is stationary and, after starting the engine injecting a cleaning solution. U.S. Pat. No. 4,989,561 teaches a cart-mounted pumping unit that is connected with an engine by attaching a solution-carrying tube when a tube is fitting into the engine. Other electrical connections are made with the engine by which the fuel injectors and ignition are monitored and/or controlled so that the cleaning solution is supplied in the correct amount and at the proper time.

Such systems require that the vehicle be taken out of service for some length of time, as at least some degree of disassembly of the engine and/or air induction system is necessary. The temporary connections with the induction system also raise issues of how to achieve an adequate seal between the solvent delivery tube and the induction system.

SUMMARY

In a first disclosed embodiment, a system for cleaning an air induction path of a motor vehicle engine comprises a reservoir mounted onboard the vehicle, in fluid communication with the induction path, and containing a solvent. A valve metering flow of the solvent into the induction path and is activated by a control module based upon a signal indicating a parameter related to operation of the engine.

According to another feature of the disclosed system, the solvent is delivered into an intake plenum of the engine.

According to another feature of the disclosed system, the solvent is delivered in a quantity calculated to collect at a low point of the intake plenum and be drawn into the engine when intake air flow exceeds a threshold rate. The low point may be a sump for collecting condensate.

According to another feature of the disclosed system, the parameter related to operation of the engine is distance travelled by the vehicle.

In another disclosed embodiment, apparatus for a motor vehicle comprises an internal combustion engine, an air intake plenum feeding into the engine, and a reservoir mounted onboard the vehicle and in fluid communication with the plenum. The reservoir contains a solvent and a valve meters flow of the solvent from the reservoir into the plenum. A control module is operative to a) receive a signal indicating a parameter related to operation of the engine, and b) based on the parameter, activate the valve to deliver solvent into the plenum and/or generate a signal notifying a vehicle driver that cleaning of the induction path is warranted.

In another disclosed embodiment, a method of cleaning an air induction path of a motor vehicle engine comprises operating an electronic control module to a) receive a signal from a vehicle sensor indicating a parameter related to engine operation, b) determine that cleaning of the air induction path is warranted based upon a parameter, and c) activate an onboard system to deliver a solvent into the air induction path during operation of the engine.

According to another feature of the disclosed method, activating the onboard system comprises triggering a valve to meter flow of the solvent from an onboard reservoir into the air induction path.

According to another feature of the disclosed method, the solvent is delivered in a quantity calculated to collect in a sump of the air induction path and be drawn into the engine when intake air flow exceeds a threshold rate.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
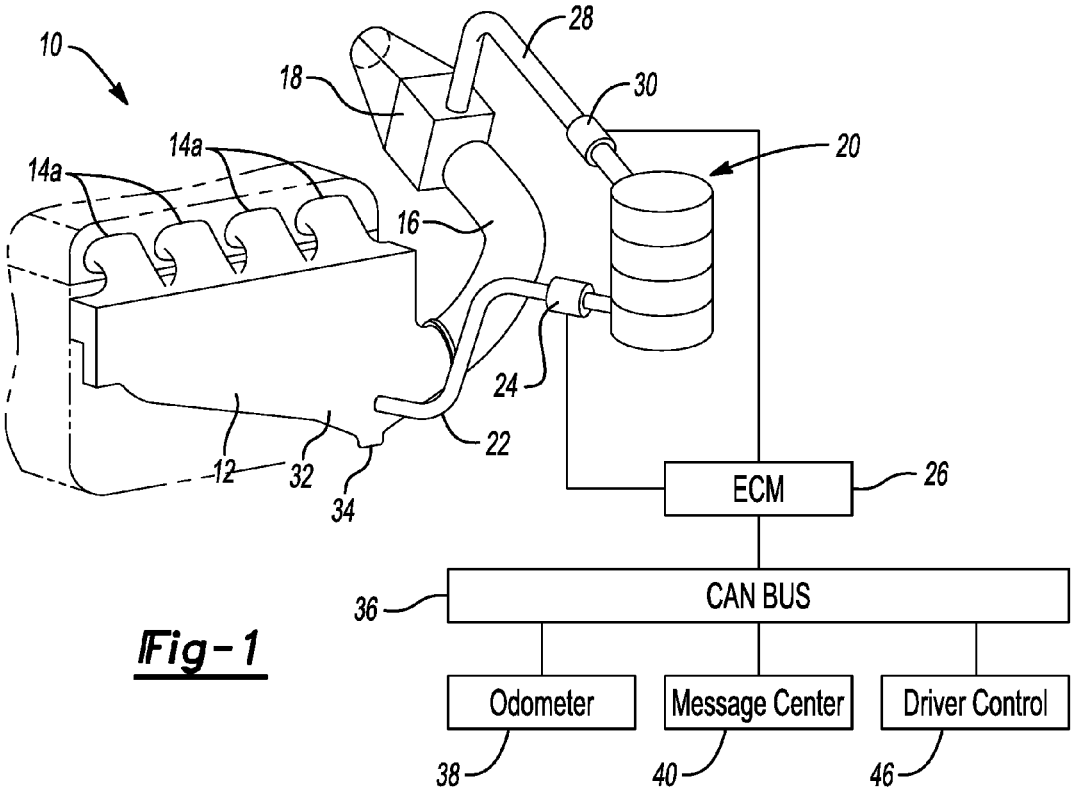
FIG. 1 is a schematic view of an air induction system of an automotive engine and an air induction cleaning system according to the present invention.

FIG. 1 illustrates (in schematic form) relevant portions of an air induction system 10. Air induction system 10 is shown as being adapted for a four-cylinder internal combustion engine (generally indicated in phantom line), however the disclosed apparatus and methods may be adapted for application to an engine with any number or cylinders, as will be apparent to a person of skill in the art. Air induction system 10 includes, as is well known in the art, an intake plenum 12 coupled to a runner pack 14 comprising a plurality of intake runners 14*a*, each of which supplies a cylinder of the engine. Intake air is supplied to the plenum 12 via an intake duct 16 which is downstream from a charge air cooler (CAC) 18 associated with a boost system such as a turbo charger or super charger (not shown). In the embodiment depicted in FIG. 1, CAC 18 may typically be a water-to-air heat exchanger.

A reservoir 20 is mounted onboard the vehicle, preferably within or adjacent to the vehicle engine compartment. Reservoir 20 holds a liquid solvent formulated to clean deposits and undesirable contaminants that form within the air induction system during normal vehicle operations. The term "solvent" as used herein is defined to include any solution or formulation intended to dissolve, neutralize, or otherwise remove any type of undesired material that may be present within the airflow path of the vehicle powertrain.

A solvent supply line or tube 22 extends between reservoir 20 and plenum 12. A valve 24 operates to meter the flow of solvent from the reservoir 20 and into the plenum 12. Valve 24 is controlled by an electronic control module (ECM) 26. A pressure line 28 extends between reservoir 20 and a point on air intake system upstream from the plenum 12 serving as a source of positive pressure to the reservoir. In the depicted embodiment, pressure line 28 connects with the intake system adjacent to a downstream side of CAC 18. A valve 30 may be positioned in or on pressure line 28 to control the pressurization of reservoir and is controlled by ECM 26. Any alternative means may be used to pressurize reservoir 20, such as a dedicated pump (not shown) or bleed air from another vehicle compressor (not shown).

The downstream end of solvent supply line 22 communicates with plenum 12 adjacent to a lowest point or sump 32 of the plenum. The location of sump 32 relative to plenum 12 will depend upon the orientation of the engine/plenum when installed in the vehicle. Sump 32 may have a drain hole fitted with a removable plug 34 to allow any accumulated liquid or solid matter to be drained from the plenum 12 during maintenance. The drain hole may also be used as an access hole for inspection of the air path if necessary.

ECM 26 is preferably a microprocessor-based device and may control multiple additional functions of the powertrain (engine, turbo- or super-charger, transmission, and/or related components) to provide optimized performance. ECM 26 may be connected to an electronic communication bus 36 (such as a CAN bus) to send and/or receive signals to/from various other vehicle sensor and/or systems. An odometer 38, a driver message display 40, and driver control 46 are examples of systems that may interface with bus 36.

Figure 2:
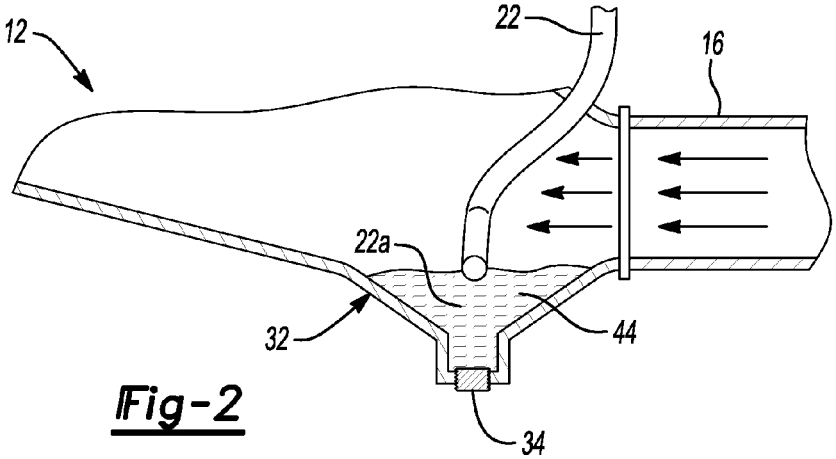
FIG. 2 is a schematic fragmentary view of the sump area of intake plenum of FIG. 1.

Referring now to FIG. 2, sump 32 is positioned relative to plenum 12 such that any liquid (such as crank case oil or condensed water vapor) deposited on the interior walls of the plenum will collect in the sump under the influence of gravity when the engine is shut down or running at relatively low air path velocities. An outlet opening 22*a* where solvent line 22 opens into plenum 12 may be immediately adjacent to and/or above sump 32 so that solvent exiting the solvent line settles in the sump area, as indicated by reference numeral 44.

In one embodiment, valve 24 meters a quantity of solvent 44 calculated (by pre-programmed logic applied by ECM 26) to be effective to remove deposits in the affected areas of the airflow path. The airflow entering plenum 12 from duct 16 (indicated by arrows A) is directed over the top of sump 32. At relatively low mass airflow rates (which generally coincide with low engine speed or revolutions-per-minute (RPMs)) the solvent 44 remains pooled in the sump. When the mass airflow rate reaches/exceeds a lower limit, however, the solvent 44 collected in sump 32 is entrained into the airflow A and carried upward through the plenum into runners 14 and into the engine cylinders. It is believed that any detrimental or noticeable effect on the engine combustion that may be caused by the solvent will be minimized when the engine is operating at relatively high mass airflow rates.

The timing of the activation of valve 24 and the amount of solution metered for delivery into the induction system are determined by ECM 26 based upon signals/inputs from one or more other vehicle components or systems, the signal(s) indicating parameter(s) related to operation of the engine. For example, vehicle mileage may be selected as the engine-related parameter on which treatment by the solvent is to be based. The signal indication this parameter may be provided to ECM 26 by odometer 38.

The specific vehicle mileage interval when treatment is warranted and the amount of solution to be delivered at that interval may be based on vehicle testing and/or historical tracking the vehicle usage and deposit build-up in the engine/induction system. Other possible engine-related parameters are engine operating time and cumulative amount of fuel burned by the engine.

Figure 3:
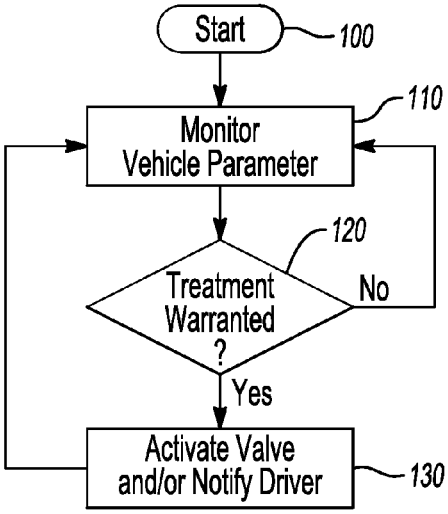
FIG. 3 is a flow chart depicting a first method for operating a cleaning system of the type shown in FIG. 1.

FIG. 3 is a flow chart of a method of cleaning and/or preventing the build-up of deposits that may be accomplished utilizing apparatus similar to that shown in FIGS. 1 and 2. The method begins at block 100, preferably at start-up of the engine. The engine-related parameter on which treatment by the solution will be based is monitored (block 110). At block 120, the measured value of the parameter is compared with one or more known threshold values to determine if treatment is warranted. When the comparison indicates treatment is warranted (block 120, "YES"), the method progresses to block 130, where the valve is activated to inject a metered volume of solution into the induction system. If desired, a message could be generated (for display on a message center 40 or similar display located in the vehicle cabin, for example) to inform the vehicle operator that a cleaning cycle has been triggered.

Alternatively, a message may be generated informing the vehicle operator that treatment is warranted and/or directing the operator to issue a command directing activation of the solvent injection system. A command may be issued by activating a driver control 46 which may be, for example, a switch, button, touchscreen, voice-recognition command. If operator-commanded activation of the system is permitted, it may be beneficial to allow the ECM 26 to monitor and override operator commands if necessary to prevent over-application of the solvent. For example, ECM 26 may be programmed to prevent more than a single application/treatment at any given mileage and/or time interval. Similarly, ECM 26 may be programmed to only allow operator-commanded activation under certain recommended engine operating conditions.

The message notifying the driver that a treatment is warranted may include instructions as to how/when to activate the system. For example, the message may direct the driver to make a manual activation immediately prior to engine shut-down for a minimum length of time (over-night, for instance), allowing the solvent to remain in the sump for several hours. The solvent may be formulated to break-down or neutralize contaminants that collect in the sump during that time.

Figure 4:
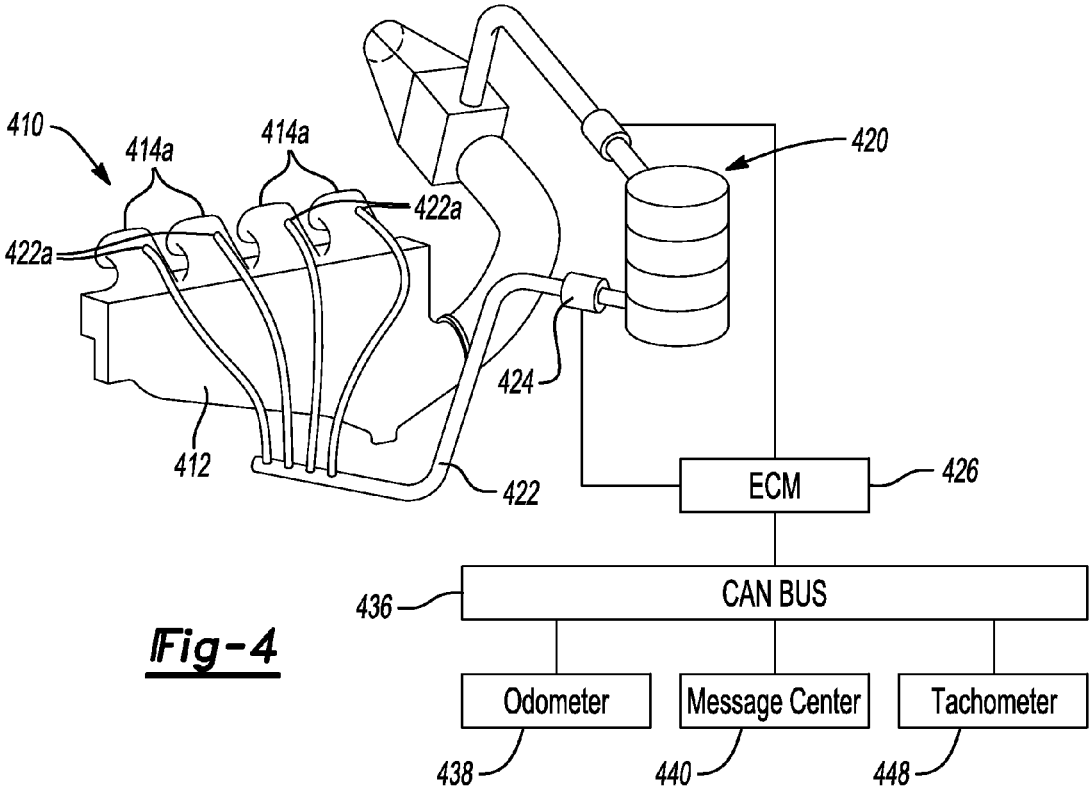
FIG. 4 is a schematic view of a second embodiment of an air induction cleaning system of an automotive engine and an air induction cleaning system.

FIG. 4 shows an alternative embodiment of an air induction treatment system 410 differing from the FIG. 1 embodiment primarily in the location in the air induction path at which the solvent is injected. Solvent supply line 422 branches into four sub-lines 422*a* that are connected with and feed into the individual intake runners 414*a*. Solvent solution contained in reservoir 420 is metered by valve 424 for delivery directly into intake runners 414*a* rather than into plenum 412, as in the FIG. 1 embodiment.

It may be desirable to operate the FIG. 4 apparatus so that solvent is only injected into the runners 414*a* when the engine is operating within a certain range of operating conditions. For example, it may be found that, for a given engine, a solvent is most effective and/or has the least noticeable effect on engine combustion when the engine is operating in a certain range of revolutions-per minute (RPMs). In such a case, ECM 426 may receive an engine speed signal from a tachometer 448 and use the signal to determine when to activate valve 424 and what quantity of solvent to inject.

In general, any solvent injection event should be administered within a specific magnitude/duration so as not to disrupt or affect combustion stability. The introduction of any solvent, flammable/or non-flammable, into the system will require the ECM to make adjustments to compensate for either a slower burn rate (non-flammable) or faster burn rate (flammable)

Figure 5:
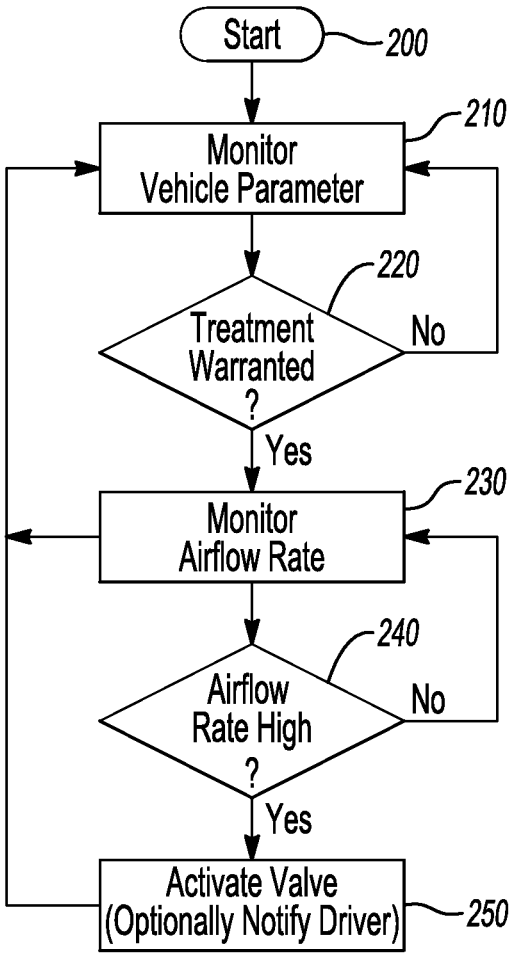
FIG. 5 is a flow chart depicting a second method for operating a cleaning system of the type shown in FIG. 4.

FIG. 5 is flow chart depicting an alternative method for activating a treatment system that may be implemented using the apparatus of FIG. 4. At block 210, an engine-related parameter is monitored and at block 220 the measured value of that parameter is compared with threshold values to determine whether treatment by the solvent is warranted. If the comparison indicates that treatment is warranted (220, "YES"), the method progresses to step 230 and mass airflow rate is monitored by the engine control module. The engine's mass airflow rate is generally directly proportional to the engine RPMs, so a signal from a tachometer may be used to estimate the actual mass airflow rate. At block 240, the measured or estimated mass airflow rate is compared with a minimum value. If the airflow rate is above the minimum value, the method progresses to block 250 and the valve is activated.

In comparison with the method shown in FIG. 3, this method preferably does not offer an option to direct or allow a driver-commanded activation because the solvent injection occurs only if the mass airflow rate is sufficient high to insure proper engine operation during the cleaning cycle.

Alternatively, a notification could be generated delivered to the driver after step 220 instructing the driver to command a solvent injection cycle. After a driver-commanded activation, the system would preferably accomplish steps 230-250 so that solvent is injected only when mass airflow rate is in the appropriate range.

An advantage of the method disclosed in FIG. 3 is that amount of solution dispensed from reservoir 20 by valve 24 need not be metered in very small, accurately controlled quantities. Rather, a single, relatively large quantity of solvent may be injected, the proper quantity being selected based on the known vehicle operating parameters and/or by monitoring a diagnostics system of the vehicle. This single metered quantity of solvent is then carried into the cylinders over a time interval depending on when and for how long the engine operates at the airflow rates required to carry the solvent from the sump into the cylinders.

As an alternative to activating the cleaning system on a regularly scheduled basis, (based upon distance traveled, the system can be triggered based upon reading/inputs from an onboard diagnostics (OBD) system. For example, if the OBD system detects the actual mass airflow rate of the engine is below a desired or nominal value, this could be interpreted as an indication that the intake valves are becoming blocked by deposits. However, it is believed that regular treatment/cleaning of the system so as to prevent any performance-degrading deposits is more practical and effective than trying to remove the deposits after they have formed.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of cleaning an air induction path of a motor vehicle engine comprising:

operating an electronic control module to a) receive a signal from a vehicle sensor indicating a parameter related to engine operation, b) determine that cleaning of the air induction path is warranted based upon the parameter, and c) activate an onboard system to deliver a solvent into the air induction path during operation of the engine via a supply line in a quantity calculated to collect in a sump of the air induction path and be subsequently drawn into the air induction path and engine when intake air flow exceeds a threshold rate sufficiently high to maintain proper engine operation, the supply line extending from an onboard reservoir to immediately adjacent to the sump.

2. The method of claim 1 wherein activating the onboard system comprises triggering a valve in the supply line to meter flow of the solvent from the onboard reservoir, the flow metered to be the quantity calculated to collect, the quantity being equivalent to an amount of solvent associated with a cleaning cycle.

3. The method of claim 1 wherein the control module is further operable to control multiple powertrain functions.

4. The method of claim 1 wherein the parameter related to operation of the engine is distance travelled by the vehicle.

5. The method of claim 1 wherein the onboard reservoir is mounted in an engine compartment of the vehicle.

6. The method of claim 1 wherein the solvent is delivered into the air induction path from the onboard reservoir pressurized by a pressure line connecting the onboard reservoir to the air induction path upstream of the sump.

7. The method of claim 1 wherein the control module is further operated to calculate the quantity of solvent based on the parameter.

8. The method of claim 1 wherein the quantity of solvent delivered to the sump is delivered in bulk as a single quantity per cleaning cycle.

9. A method comprising:

operating a controller while operating an engine to (i) activate an onboard system to deliver solvent via a supply line extending from a reservoir into an air intake plenum sump to pool therein in response to determining from an engine operating parameter signal that cleaning of an air induction path is warranted, and (ii) control airflow such that solvent is entrained from the sump over a time interval to clean the path.

10. The method of claim 9 further wherein the controller is further operated while operating the engine to pressurize the reservoir by controlling a valve in a pressure line connecting an air intake system upstream of an air intake plenum to the reservoir.

11. The method of claim 9 wherein the controller is further operated while operating the engine to control a valve in the supply line to deliver a single metered quantity of solvent associated with a cleaning cycle into the sump.

12. The method of claim 9 wherein the controller is further operated while operating the engine to generate a message for display on a message center located in a vehicle cabin to inform a vehicle operator that a cleaning cycle has been triggered.

* * * * *